US009446301B2

(12) United States Patent
Leimberer

(10) Patent No.: US 9,446,301 B2
(45) Date of Patent: Sep. 20, 2016

(54) PROJECTILE TARGET GAME

(76) Inventor: Dwight Albert Leimberer, Saint Paul, MN (US)

( * ) Notice: Subject to any disclaimer, the term of this patent is extended or adjusted under 35 U.S.C. 154(b) by 0 days.

(21) Appl. No.: 12/875,046

(22) Filed: Sep. 2, 2010

(65) Prior Publication Data

US 2011/0062668 A1 Mar. 17, 2011

Related U.S. Application Data

(60) Provisional application No. 61/239,355, filed on Sep. 2, 2009.

(51) Int. Cl.

| | |
|---|---|
| ***F41J 7/00*** | (2006.01) |
| ***A63F 9/02*** | (2006.01) |
| ***F41J 1/00*** | (2006.01) |
| ***F41J 5/18*** | (2006.01) |
| ***F41J 7/04*** | (2006.01) |

(52) U.S. Cl.

CPC ..... *A63F 9/0204* (2013.01); *F41J 1/00* (2013.01); *F41J 5/18* (2013.01); *F41J 7/04* (2013.01)

(58) Field of Classification Search

CPC ..... F41J 7/04; F41J 7/04; F41J 7/02; F41J 1/00; F41J 1/01; F41J 1/10; F41J 3/0004; F41J 5/18; F41J 5/24; A63F 9/0415; A63F 9/0204; A63B 43/002; A63B 43/06

USPC ..... 273/390–392, 403–410; 446/431, 446/450–453; 416/78

See application file for complete search history.

(56) References Cited

U.S. PATENT DOCUMENTS

| | | | | |
|---|---|---|---|---|
| 157,335 | A * | 12/1874 | Lyon | 273/388 |
| 1,030,554 | A * | 6/1912 | Wharton | 273/146 |
| 1,424,632 | A * | 8/1922 | Fenton | 273/392 |
| 1,537,738 | A | 5/1925 | Bisbing | |
| 2,967,712 | A * | 1/1961 | Breitenfeldt | 273/388 |
| 3,635,476 | A * | 1/1972 | Breslow et al. | 273/390 |
| 3,868,115 | A * | 2/1975 | Faiferlick | 273/146 |
| 3,979,118 | A * | 9/1976 | Saunders et al. | 273/388 |
| 4,245,843 | A | 1/1981 | Griggs | |
| 4,283,060 | A * | 8/1981 | Braunschweiler | 273/383 |
| 4,650,189 | A * | 3/1987 | Rajacich | 473/434 |
| 4,850,596 | A * | 7/1989 | Olund | 273/408 |
| 5,352,144 | A * | 10/1994 | Kuhn | 446/176 |
| 6,491,303 | B1 | 12/2002 | Huston | |
| 7,114,725 | B2 * | 10/2006 | Camp et al. | 273/390 |
| 7,134,977 | B2 * | 11/2006 | Campbell et al. | 473/454 |

(Continued)

FOREIGN PATENT DOCUMENTS

GB 2187270 A 9/1987

OTHER PUBLICATIONS

WIPO, U.S. International Search Authority, International Search Report mailed Oct. 25, 2010 in International Patent Application No. PCT/US2010/047746, 2 pages.

*Primary Examiner* — Mark Graham

(74) *Attorney, Agent, or Firm* — Inskeep IP Group, Inc.

(57) ABSTRACT

Reactive targets and target frames are provided that react to being impacted by a projectile in such a manner as to cause longitudinal movement and/or rotation of the target frame. The movement, in turn, exposes different primary targets and/or a secondary target(s) to the participant. Participants can take either offensive shots against the competitor's targets or defensive shots to protect their targets from being impacted by the competitor.

4 Claims, 10 Drawing Sheets

(56) References Cited

U.S. PATENT DOCUMENTS

| | | | | |
|---|---|---|---|---|
| 7,448,967 | B1 * | 11/2008 | Panneri et al. | 473/387 |
| 7,712,743 | B1 * | 5/2010 | Miller | 273/407 |
| 8,083,483 | B1 * | 12/2011 | Thorsbakken | 416/78 |
| 2003/0034612 | A1 | 2/2003 | Yoon | |
| 2008/0252016 | A1 * | 10/2008 | Palmer | 273/390 |

* cited by examiner

Fig. 5A
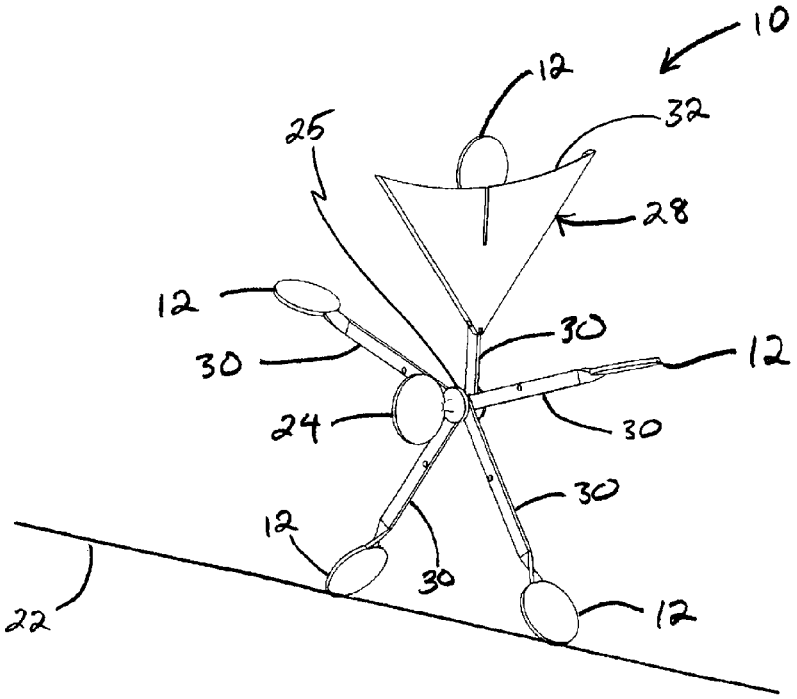
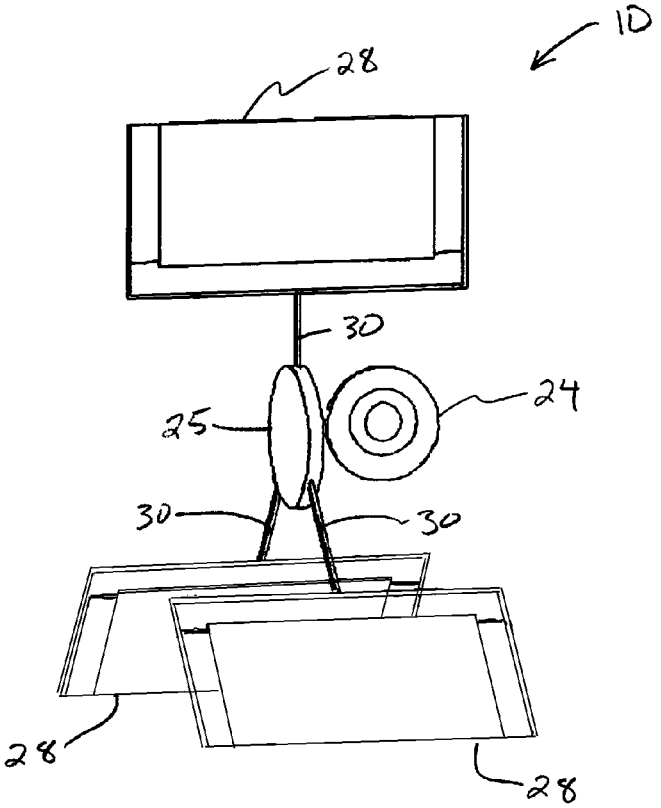
Fig. 5B

PROJECTILE TARGET GAME

RELATED APPLICATIONS

This application claims priority to U.S. Provisional Application Ser. No. 61/239,355 filed Sep. 2, 2009 entitled Projectile Target Game, the contents of which are incorporated in their entirety herein.

FIELD OF THE INVENTION

This invention relates generally to the field of projectile targets and games and training techniques incorporating the same. More particularly, the present invention relates to reactive targets and frames supporting such targets and methods for employing the same as competitive, interactive entertainment and training.

BACKGROUND OF THE INVENTION

Currently practices and equipment directed to hitting targets with projectiles are focused almost exclusively on participants individually developing accuracy and consistency. For example, competitive shooting, or marksmanship, competitions are generally sequential in nature. Shooters take turns shooting their best and then wait to see if another participant performs better. Such competitions fail to provide the participants with an engaging, dynamic entertainment or training experience.

In contrast, many activities such as traditional team sports, including football, hockey, and basketball; individual sports, such as tennis, and other forms of entertainment, such as video or online gaming provide the participants with a dynamic experience by not only challenging the participants' physical skills but also through challenging the participants to out-think or out-strategize fellow participants during direct competition. In the case of many video games, multiple participants are not required in order to provide a dynamic, interactive experience to the participant, because the game is designed to change, for example, become more difficult or create a different game environment, as the participant completes certain tasks.

In order to compete with the multitude of interactive and dynamic activities available and thereby draw new and younger participants into the various forms of projectile target entertainment and training, such as marksmanship, archery, or even pitching baseballs, new interactive targets and methods for using the same are needed in the field.

OBJECTS AND SUMMARY OF THE INVENTION

The objective of the present invention is to provide safe, yet highly intensive, competitive projectile target systems and games that are interactive and dynamic for the participants. The systems and methods of the present invention provide entertainment and training that involves projectile targeting skills, strategy development, and a competitive environment for single or multiple participants.

These objectives are achieved by providing individual targets that are reactive to being hit by a projectile and/or by providing target frames that are reactive to the target within the target frame being hit by a projectile. The reactive target frames react to being impacted by a projectile in such a manner as to cause longitudinal movement and/or rotation of the target frame or a portion of the target frame. This movement, in turn, exposes different primary targets and/or a secondary target(s) to the participant. Accordingly, participants can take either offensive shots against the competitor's targets or defensive shots to protect their targets from being impacted by the competitor.

BRIEF DESCRIPTION OF THE DRAWINGS

FIG. 5A is a partial perspective view of a target system according to one embodiment of the present invention.

FIG. 5B is a perspective view of a target system according to one embodiment of the present invention.

DESCRIPTION OF EMBODIMENTS

Figure 1B:
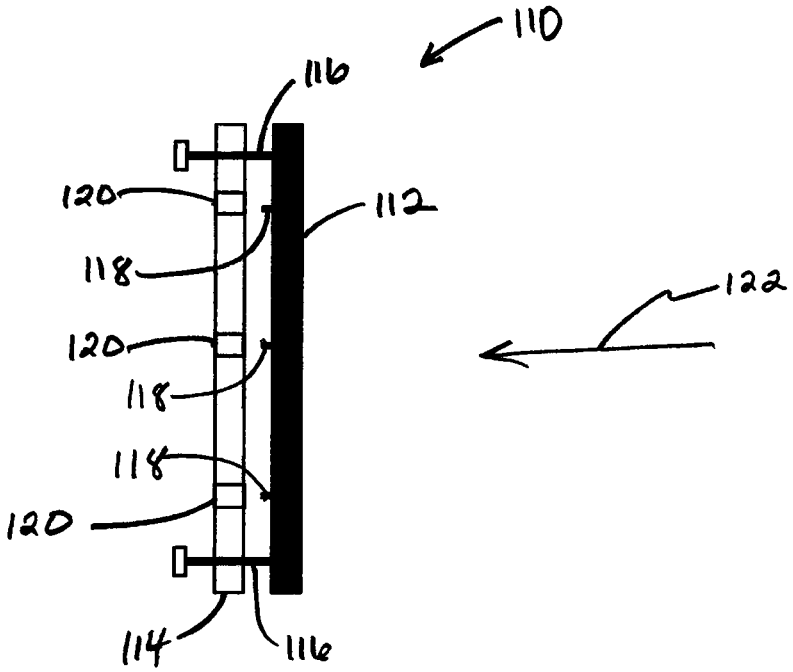
FIG. 1B is a cross-sectional view along line d of FIG. 1A of a secondary reactive target according to one embodiment of the present invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

The targets and target frames of the present invention provide an interactive, dynamic experience that involves strategy and projectile targeting skills for single or multiple participants.

As used in the present disclosure, the term projectile and projectiles includes, but is not limited to, objects fired from guns, rifles, shotguns, BB guns, air guns, sling shots, pellet guns, and air soft guns; arrows, either blunt or sharp tipped; balls, such as baseballs, footballs, basketballs, soccer balls, tennis balls, and golf balls; hockey pucks; and other objects operable to be impelled forward by a participant. In order for targets and target frames to accommodate these various types of projectiles, reactive targets and target frames according to the present invention may be fabricated using a variety of materials that facilitate the reactive nature of the targets and target frames. The shape and sizes of the targets and target frames may also vary depending on the type of projectile intended to be used. While many of the below described embodiments are described as being configured for use with relatively small, fast moving projectiles such as those fired from side arms, rifles and other firearms, it is contemplated that these and similar embodiments can easily be configured for use with, at least, any of the above listed projectiles without departing from the spirit of the present invention.

According to the present invention, reactive targets are targets that provide feedback, preferably instant feedback, to the participant(s). Two types of reactive targets are employed in the present invention, primary reactive targets and secondary reactive targets. The primary reactive targets are generally rigidly attached to the target system. When a primary reactive target is hit by a projectile, the force of the impact of the projectile upon the primary reactive target moves the target. In turn, the force of the impact is transferred to the target frame or a portion of the target frame to which the primary reactive target is attached, thereby causing movement of the target frame or movement of a portion of the target frame. The target frame may be operable to move to two or more different positions or orientations relative to the perspective of the participant. Each of the different positions or orientations of the target frame exposes one or more different reactive targets to the participant.

Primary reactive targets can be fabricated of materials such as polymer, rubber, metal alloy, or any other material that can be struck by a projectile and transfer the force of the impact to the target frame or a portion of the target. Primary reactive targets can employ different mechanisms for receiving and transferring the force of the projectile impact to the target frame. For example, in certain embodiments, the reactive target is fabricated to resist breakage and penetration by the projectile. In such embodiments, the direction of deflection of the projectile can be controlled in order to capture the projectile for latter use or to safely remove the projectile from the area surrounding the target. In certain other embodiments, the reactive target is designed to stop and capture the projectile within the reactive target. This design is also useful in order to safely stop and remove the projectile from the area surrounding the target. In yet another embodiment, the reactive target is fabricated to allow the projectile to pass through the target. The target will receive a portion of the force of the projectile sufficient to result in the desired movement of the target frame or a portion of the target frame but otherwise allow the projectile to pass through the target.

Unlike the primary reactive targets, the impact of a projectile upon the secondary reactive targets does not result in movement or rotation of the target frame to expose or hide different reactive targets. Impact of the projectile upon the secondary reactive target is primarily intended to notify the participant(s) that the secondary reactive target has been impacted. In certain embodiments, an impact upon a secondary reactive target may serve to both notify the participant(s) that the secondary reactive target has been impacted and to expose another secondary reactive target. As will be described in greater detail below, the secondary reactive target may function as an objective that one participant works to protect by impacting primary reactive targets that move the secondary reactive target out of line of site and/or impact. Conversely, another participant may work to impact the primary reactive targets to move the target frame in order to expose and impact the secondary reactive target.

Figure 1A:
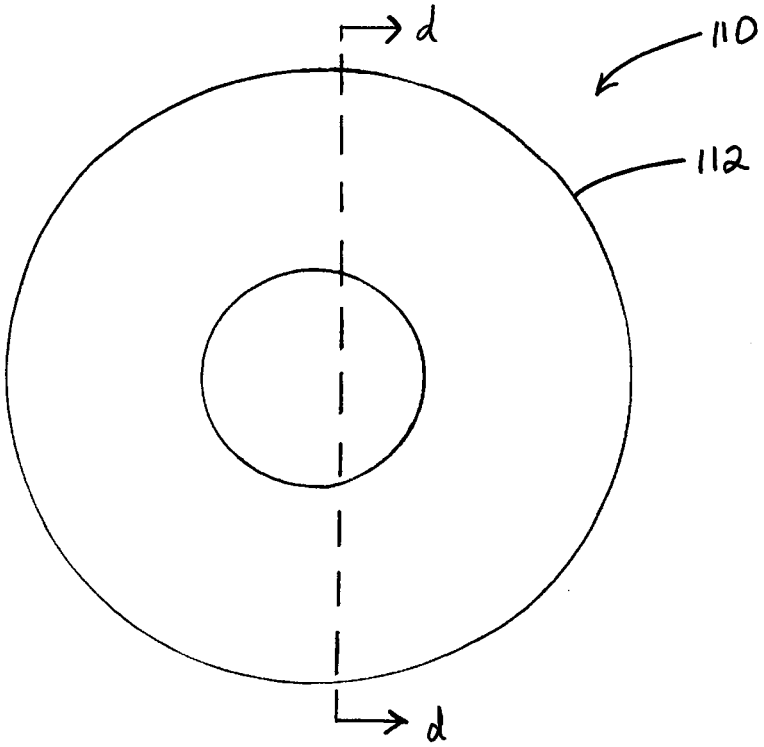
FIG. 1A is a front elevation view of a secondary reactive target according to one embodiment of the present invention.

In certain embodiments of the secondary reactive target, projectile impact upon the secondary reactive target results in an audible and/or visual indication to the participants that the secondary reactive target has been impacted. For example, as shown in FIG. 1B, as cross-sectional view along line "d" of FIG. 1A, the secondary reactive target 110 comprises a strike plate 112 attached to a reporter plate 114 by one or more slide members 116. In operation, impact of the strike plate 112 by a projectile traveling in the direction of arrow 122 causes the strike plate 112 to move in the same direction as the arrow 122, i.e. to deflect towards the reporter plate 114. The strike plate 112 and the reporter plate 114 are aligned such that pins 118 projecting out from the back surface of the strike plate 112 are aligned to receivers 120 formed in the reporter plate 114. Within the receivers 120 of the reporter plate 114 are percussion caps or starter gun cartridges. In order to maintain the strike plate 112 separate from the reporter plate 114, springs or similarly functioning elements may be interposed between the strike plate 112 and the reporter plate 114. When a projectile impacts the strike plate 112, the strike plate 112 is forced towards the reporter plate 114 and the pins 118 of the strike plate 112 are forced into the receivers 120 thereby causing the discharge of the percussion caps or cartridges. Accordingly, the participants are notified that the secondary reactive target has been impacted. Alternatively, a packet of chalk or other powder may be employed in combination or individually with the present secondary reactive targets in order to provide a visual signal that the target has been impacted.

It will be recognized that the above described secondary reactive target may be configured such that with each impact by a projectile, the impact plate 112 and the reporter plate 114 are rotated relative to one another in order to advance a single pin 118 to alignment with another receiver 120 containing an unused percussion cap. In this manner, a single secondary reactive target may be impacted several different time during competition and operable to report each of the individual impacts.

It will be appreciated that the objectives of the above described secondary reactive target can also be achieved through single use-type secondary targets such as, for example, balloons with targets printed upon them or a variety of objects comprising or filled with chalk. For example, placing a relatively small amount of chalk or other powder inside a balloon creates an effective secondary target. This can be achieved in multiple ways, such as inflating the balloon with a pressurized canister containing an air-powder mixture or by placing a single packet of chalk or other powder inside balloon and then crushing the packet either before or after inflation of the balloon.

In a second embodiment, impact of the secondary reactive target may remove the secondary reactive target from play. For example, impact of the secondary reactive target may destroy or obscure the secondary reactive target from the participant. Accordingly, the secondary reactive target may, for example, be a clay target that shatters upon impact or a block or disc of material that simply dislodges or is knocked down or out of position when struck by the projectile. In the case of shattering targets, such as clay pigeons, in order to ensure that the target shatters completely, a secondary reactive target assembly may employ a metal or other rigid material plate directly behind the shattering target. Through enhanced deflection and vibration, the projectile's impact upon the plate will ensure that the shattering target shatters completely.

In a third embodiment, impact of the secondary reactive target may move or cause the entire target system or frame to fall to the ground, effectively removing the entire system from play and ending the competition. In a forth embodiment, the secondary reactive target is attached to the target frame by a hub or a tensioning member that maintains the target frame in an assembled state. Impact of the secondary reactive target dislodges the attached hub or securing member from the target frame thereby causing the target frame to collapse, again, effectively removing the target system form play and ending the competition.

Based on the above descriptions of the primary and secondary reactive targets, it becomes evident that the secondary reactive targets must be held in position within the target system such that they are accessible for impact and are sufficiently secured so as not to be dislodged during movement of the system resulting from impact of the primary reactive target. Additionally, in the configurations in which breaking secondary reactive targets are employed, the target should be held within the target system such that the secondary reactive target will not inadvertently break during the movement of the system due to impact of a primary reactive target.

Figure 1C:
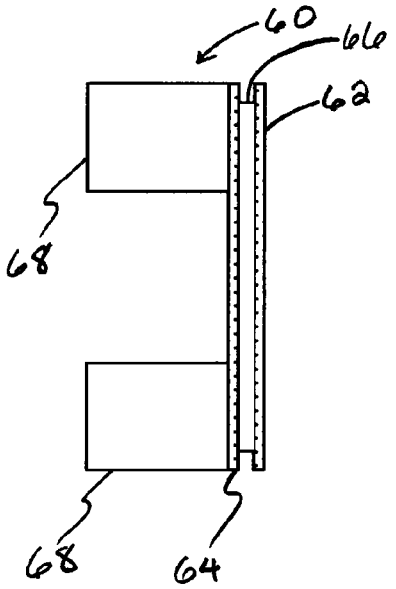
FIG. 1C is a side elevation view of a holder for a secondary reactive target according to one embodiment of the present invention.
Figure 1D:
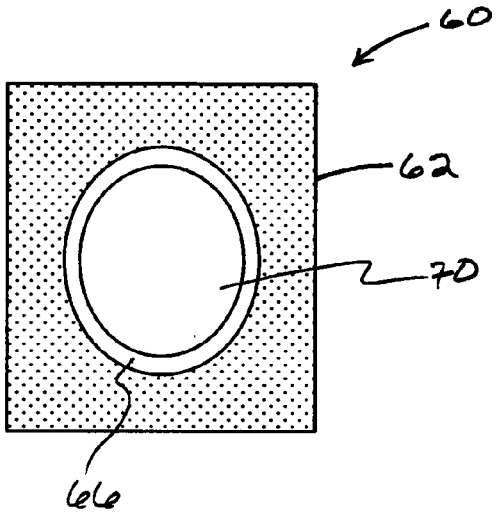
FIG. 1D is a front elevation view of a holder for a secondary reactive target according to one embodiment of the present invention.

FIGS. 1C and 1D show a holding assembly 60 comprising a face plate 62, a back plate 64, and a layer 66 interposed between the face plate 62 and the back plate 64. Attached to a back surface of the back plate 64 are one or more blocks 68. As seen in FIG. 1D, a hole 70 is cut through the face plate 62, the back plate 64, and the layer 66. A diameter of the hole 70 cut into the layer 66 is smaller than a diameter of the hole 70 cut through the face plate 62. The diameter of the hole 70 cut through the layer 66 is smaller than the diameter of the secondary reactive target, not shown, and the diameter of the hole 70 cut through the face plate 62 is slightly larger than the diameter of the secondary reactive target. The layer 66 is fabricated from a flexible material such as rubber or foam.

In use the secondary reactive target is manipulated into the hole 70 such that it is exposed through hole 70 cut through the face plate and is securely held in place with in hole 70 by the layer 66. Hole 70 may but need not necessarily be cut through back plate 64. Similar to the layer 64, the blocks 68 are fabricated from a flexible material such as rubber or foam and serve as the attachment point of the assembly 60 to the target frame. The face plate 62 and the back plate 64 provide rigidity to the assembly 60, and the layer 66 and the blocks 68 serve to cushion the secondary reactive target from breakage.

The primary and secondary reactive targets are sized and shaped large enough for the participant to potentially impact the target at the desired distance with the intended projectile. The smaller the target surface, the closer the participant needs to be in order to engage the target. For example, a reactive target intended to be engaged at 25-50 yards with a firearm may only need to have a width or height of approximately 2 inches. Alternatively, a reactive target intended to be engaged at 75-100 yards with a firearm may need to have a width or height of 4-8 inches.

According to the present inventions, one or more primary and secondary reactive targets are attached to a target frame. Target frames or systems according to the present invention can, for the sake of clarity and not by way limitation, be categorized by their type of movement. In certain embodiments, impact of a primary reactive target attached to a traveling target frame or system results in the target system traveling or moving in a direction either substantially parallel to a participant's line of sight to the target system or in a direction perpendicular to a participant's line of sight to the target system. In certain other embodiments, the target system remains stationary relative to the participant and only the portion of the target frame that is attached to the primary reactive target moves along with the primary reactive target. In such target systems the movement of the portion of the target frame and the associated primary reactive target is restricted to movement or rotation about a fixed axis defined by the target frame. Each of these types of target system will now be described with reference to the figures.

Traveling Target System

Traveling target frames or systems rotate and thereby move at a predictable direction and distances each time a projectile hits an exposed primary reactive target. This predictability allows the target frame to be equipped with secondary reactive targets that are also exposed in a relatively predictable pattern as the traveling target system rotates and moves relative to the participant(s). As shown in FIGS. 2-8 the traveling target systems can be configured in multiple forms, for example, as a triangle, square, or five pointed star.

Figure 2:
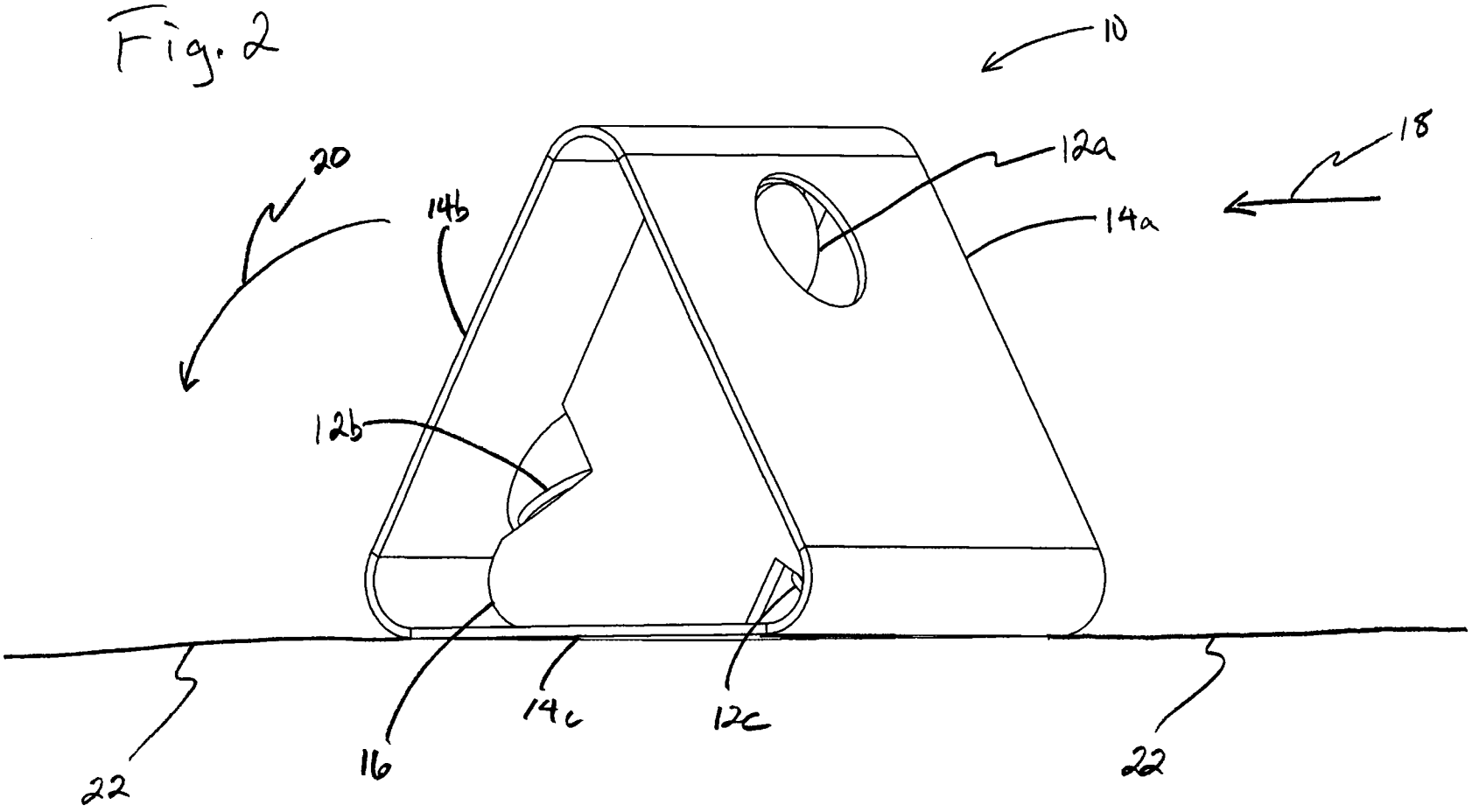
FIG. 2 is a perspective view of a target system according to one embodiment of the present invention.

For example, FIG. 2 shows a target system 10 employing primary targets 12*a*, 12*b*, 12*c* and sides 14*a*, 14*b*, 14*c* supported by internal support 16. As shown, the side 14*c* of the triangular target system 10 is at rest upon a surface or ground 22. The participant (not shown) is positioned to view the side 14*a* and the primary target 12*a* along the direction of arrow 18. Upon impact of the primary target 12*a* by a projectile traveling along the direction of the arrow 18, the target system 10 rotates in the direction of arrow 20. After rotation of the target system 10 along arrow 20, side 14*b* of the target system 10 will rest upon the ground 22 and side 14*c* and primary target 12*a* will be exposed to the participant viewing the target system along arrow 18. After the above described rotation of the target system 10, the target system 10 will have moved away from the participant a distance approximately equal to a length of side 14*b* from the junction of the side 14*b* with the side 14*a* to the junction of side 14*b* with the side 14*c*.

Figure 3:
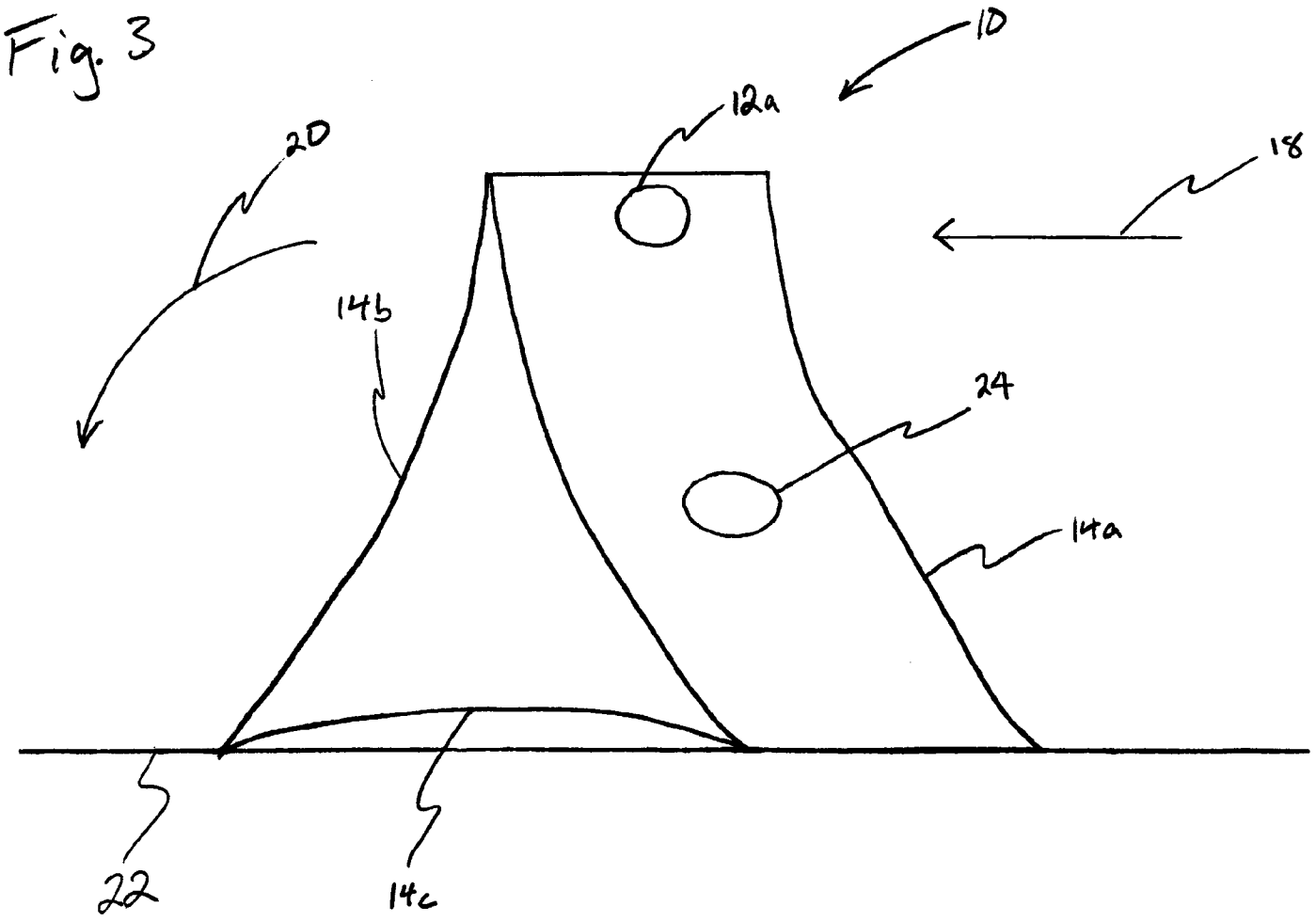
FIG. 3 is a perspective view of a target system according to one embodiment of the present invention.

FIG. 3 shows a triangular shaped target system 10 similar to that shown in FIG. 2 with the exception that each of the sides 14*a*, 14*b*, 14*c* are concaved and with the exception that the side 14*a* employs a secondary target 24. As shown, the secondary target 24 is positioned at a more centralized location on the side 14*a* as compared to primary target 12*a* which is positioned approximate an end of side 14 that forms a junction with the side 14*b*. As described above, the secondary target 24 comprises a material that is intended to break or otherwise notify the participant(s) that the secondary target 24 has been impacted. The centralized position of the secondary target 24 within side 14*a* serves to focus any force transferred to the target system 10 from the impact of the projectile with the secondary target 24 to a central location within the target system 10. In contrast, the off-centered location of the primary target 12*a* serves to maximize transfer of the impact of a projectile upon the primary target 12*a* to leverage and rotate the target system 10 in the same direction as the projectile was traveling prior to impact, i.e. along arrow 18.

The relatively few and large sides provided in the triangular shaped traveling targets shown in FIGS. 2 and 3 allows for easier attachment of secondary reactive targets to the target system and requires fewer impacts of the primary reactive targets 12*a*-*c* in order to expose the secondary reactive target 24. Accordingly, the triangular design may provide participants with a faster paced competition.

Figure 4:
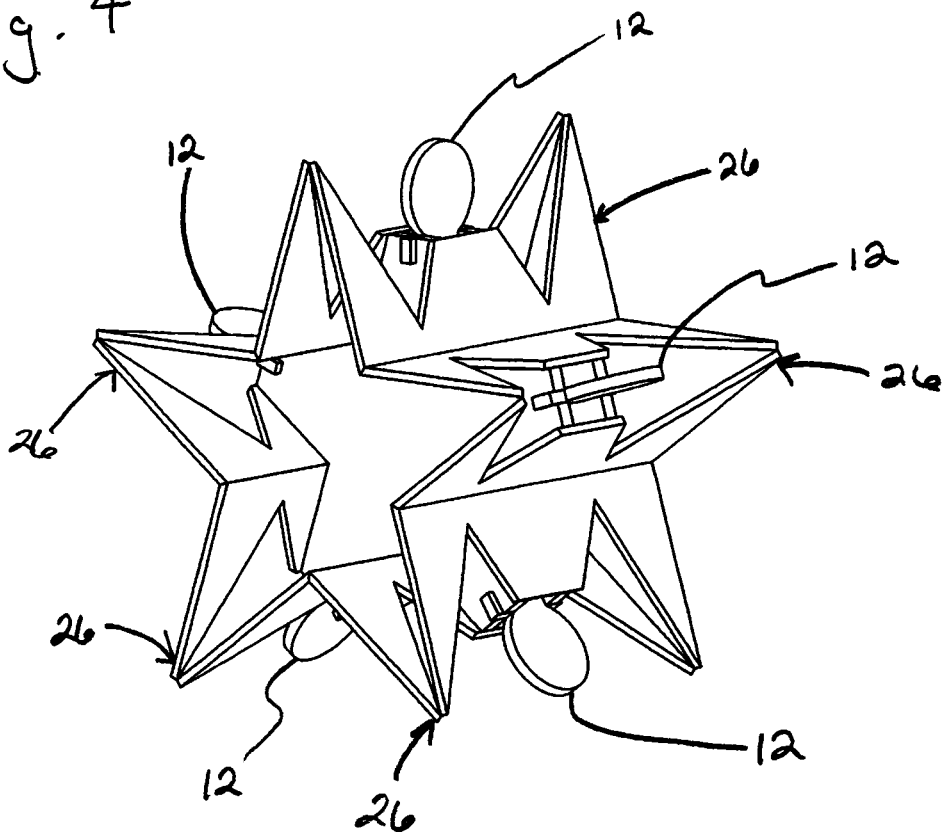
FIG. 4 is a perspective view of a target system according to one embodiment of the present invention.

FIG. 4 shows another embodiment of a traveling target system 10 employing star-shaped form. As shown, each arm 26 or the star-shaped target system 10 comprises a primary reactive target. The secondary reactive targets, not shown, can be employed in a variety of places including on the arms 26 below the primary reactive target 12 or on a support projecting from one or more sides of the target system 10.

FIG. 5A is a partial view of a target frame 10 having a paddle wheel form. As shown, the primary reactive targets 12 are individually attached to one end of each of five supports 30. The opposite ends of the supports 30 are attached to each other, as well as to a secondary reactive target 24. Also attached to supports 30 are paddles 28. For the sake of clarity, only one paddle 28 is shown in FIG. 5A. Paddles 30 employ distal ends 32 that are shaped and sized such that when the distal ends 32 of at least two paddles 30 are resting upon the surface 22, the target system 10 is supported and stabilized in a vertical, up-right position as shown in FIG. 5A. While the paddle wheel form traveling target system of FIG. 5A is shown and described as having five paddles 28, it will be understood that paddle wheel-type target frames according to the present invention may employ as few as three paddles 28 or more than five paddles 28.

The secondary reactive target 24 of the target system 10 shown in FIG. 5A, may be attached to a support hub 25 such that when the secondary reactive target 24 is impacted by a projectile, the support hub 25 releases rigidity of the support 30 relative to one another and the target system 10 falls to the ground 22. Alternatively, the secondary reactive target 24 may be rigidly attached to the support hub 25 such that when the secondary reactive target 24 is impacted by a projectile, the target frame 10 is moved or tipped-over to remove the target system 10 from play.

FIG. 5B shows an alternative configuration of a paddle wheel form target system according to the present invention. The target system 10 shown in FIG. 5B is configured for us with, for example, blunt tipped arrows. In this configuration, primary reactive targets are incorporated into the paddles 28. The paddle 28 may, for example be fabricated of a cloth or plastic resistant to penetration from the blunt tipped arrow. The movement of the target system 10 and functionality of the secondary reactive target 24 are similar to that described above regarding FIG. 5A.

Figure 6B:
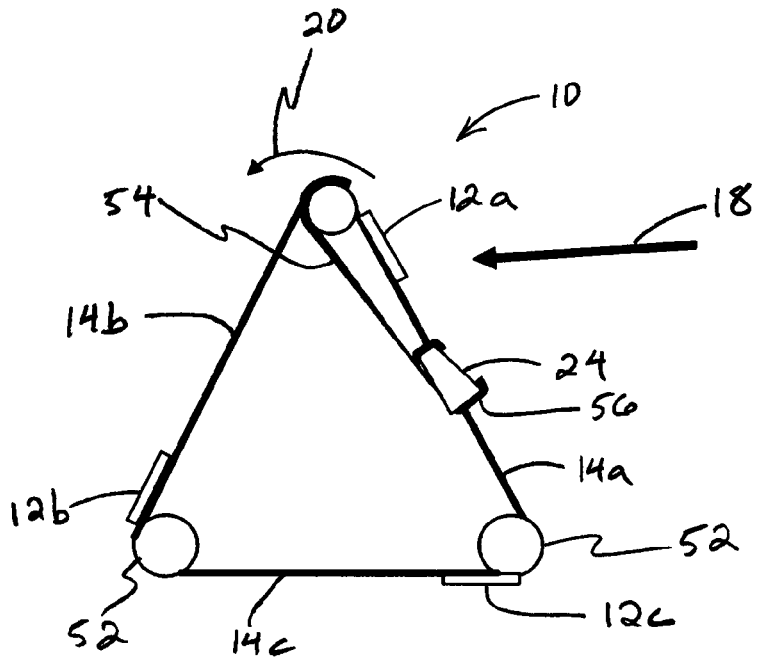
FIG. 6B is a cross-sectional view along line f of FIG. 6A of a target system according to one embodiment of the present invention.
Figure 6A:
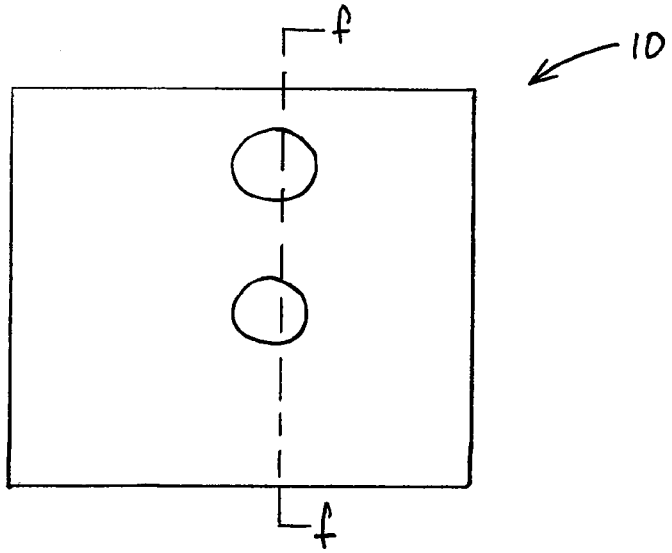
FIG. 6A is a front elevation view of a target system according to one embodiment of the present invention.

FIG. 6B shows a cross-sectional view along line "f" of FIG. 6A that illustrates another embodiment of the collapsing traveling target according to the present invention. As shown, the target system 10 is a triangular target system comprises sides 14*a*, 14*b*, 14*c* and two hinges 52 attaching the sides 14*a* to the side 14*c* and the side 14*c* to the side 14*b*. The target frame 10 further comprises primary reactive targets 112*a*, 112*b*, 112*c;* secondary reactive target 124; and tension member 54. The tension element 54 is attached at one end to the side 14*b* and at the other end is attached to the secondary reactive target 24. The secondary reactive target 24 is held in place by holder 56 positioned within the side 14*a* by, for example, a friction fit. When the target frame 10 is assembled for use, the side 14*b* is held against the side 14*a* by the tension generated by the tension member 54 pulled between the side 14*b* and the secondary reactive target 24.

When a projectile traveling in the direction of arrow 18 impacts the primary target 12*a*, as described above with regard to the target system 10 shown in FIG. 2, the target system 10 rotates away from the participant in the direction of arrow 20. In contrast, when a projectile traveling in the direction of arrow 18 impacts the secondary reactive target 24, the secondary reactive target 24 is broken or otherwise dislodges from the holder 56 thereby releasing the tension generated through tension member 54. Accordingly, the tension member 54 ceases to pull the side 14*b* into the side 14*a* and the entire target system 10 collapses.

The traveling target frames described above and shown in FIGS. 2-6 may alternatively be employed using a track or track-like system. For example, two elongated members such as two pieces of lumber or PVC pipe may be positioned and anchored upon a surface or ground 22 extending away from the participants. The tracks may be spaced apart such that the traveling target frame fits snuggly between the tracks. During competition, as the target systems are moved away from the participants through impact of the primary reactive targets with projectiles, the movements of the target frame is guided by the two elongated members on either side of the target frame. This configuration serves to maintain the target frame in a preferred orientation relative to the participant as the target frame is moved.

In addition to or in place of the above described tracks, the target system may be positioned on a surface having ridges or teeth that are oriented perpendicular to the direction in which the participant views the target system and the direction in which the projectile travels. This configuration provides a more precise incremental movement of the target system with each impact of the primary reactive targets, as well as resists undesired sliding or movement of the target system.

Figure 7:
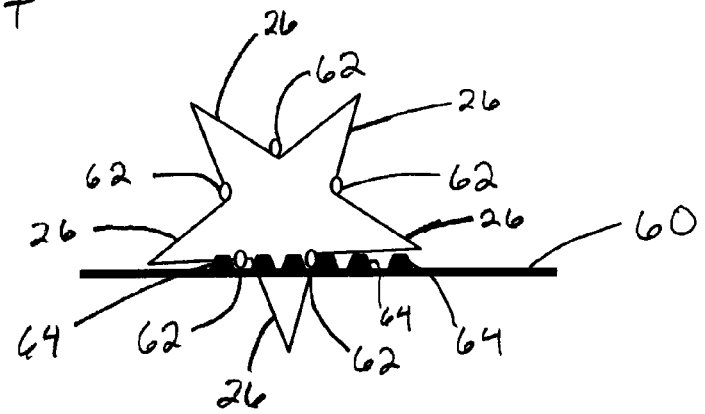
FIG. 7 is a side elevation view of a target system according to one embodiment of the present invention.

In yet an alternative embodiment of traveling target systems employing tracks, FIG. 7 shows the tracks 60 elevated above the surface or ground. The target system 10 is suspended between the tracks by suspension members 62. Shown in FIG. 7 is a star-shaped target system 10 similar to that described above and shown in FIG. 4. The suspension members 62 are formed from bars or dowels attached to the target system 10 and extending beyond each side of the target system 10.

To prevent the target system 10 from sliding away from the participant when impacted by a projectile, the tracks 60 may employ notches or teeth 64. The notches or teeth 64 are spaced apart such that the suspension members 62 are locked between the individual notches or teeth. Accordingly, when the primary reactive targets (not shown) are impacted by a projectile, the target system 10 rotates around the axis of one of the suspension members 62 upon which it rests. Movement of the target system 10 is between suspension members 62 as opposed to legs 26, as described with respect to the system of FIG. 4. It will be appreciated that by suspending the target system 10, the target system 10 is free to rotate either towards the participants, if the projectile impacts a primary reactive target on the leg 26 pointing toward the ground, or away from the participant, if the projectile impacts a primary reactive target on the leg 26 pointing upwards.

In an alternative configuration of the above described target systems employing tracks, in place of the suspension member 62, recesses may be formed in the target frames that are complementary to the size and shape of the tracks. The recesses may be place upon the tracks and provide similar functionality to that described above regarding the target system shown in FIG. 7.

Figure 8:
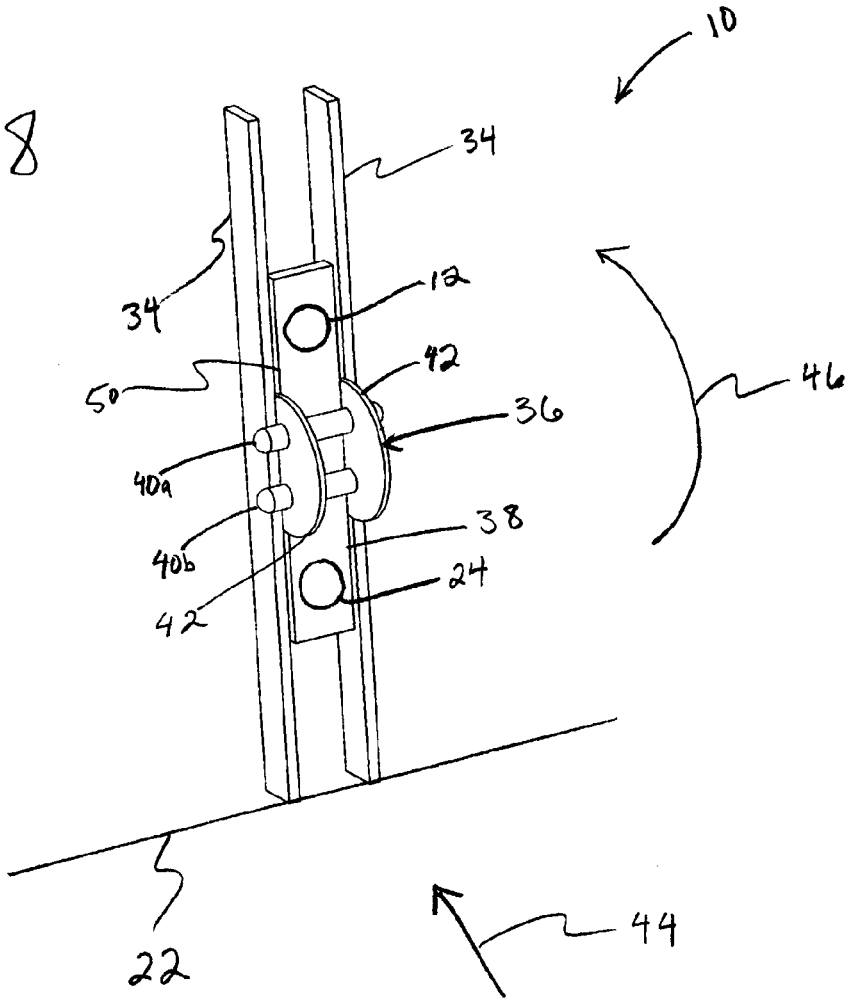
FIG. 8 is a perspective view of a target system according to one embodiment of the present invention.

As shown in FIG. 8, in an alternative embodiment, the traveling target system according to the present invention employs a target assembly 36 that is operable to vertically rotate and thereby travel up and down target members 34. The target members 34 rest upon or are anchored within the surface or ground 22 and remain stationary relative to the participant. As shown in FIG. 8, the target assembly 36 comprises a target support 50 to which one or more primary reactive target 12 and one or more secondary reactive target 24 are attached. For example, primary reactive targets 12 and secondary reactive targets 24 may be equally distributed on each side of the support 50 or may be unequally distributed on each side of the target support 50, e.g. one side of the target support 50 may have two primary reactive targets 12 and the opposite side may have one primary reactive target 12 and one secondary reactive target 24. Bars 40*a*, 40*b* pass through alignment plates 42 between which target support 50 is interposed. The target support 50 may be attached to the either or both of bars 40*a*, 40*b* or and the alignment plates 42. With the exception of the bars 40*a*, 40*b*, the target assembly 36 is positioned between the target members 34. Bars 40*a*, 40*b*, are magnetized and thereby associated to the support members 34. Alternatively, support members 34 may be magnetized.

In operation, participants view the target system 10 along the direction of arrow 44. A projectile traveling along the direction of the arrow 44 impacts the primary reactive target 12. The force of the impact of the projectile on the primary reactive target 12 is transferred to the target support 50 which, in turn, causes the end of the target support 50 opposite the primary reactive target 12 to rotate in the direction of the arrow 48, i.e. towards the participant and upward, around the axis of the bar 40*a*. The force of the impact of the projectile upon the primary reactive target 12 temporarily breaks the magnetic association of the bar 40*b* from the target members 34, thereby allowing rotation of the target assembly 36 about the axis of the bar 40*a*. The rotation ends with the target support 50 having moved up the frame members 34 a distance equal to a distance between the bar 40*a* and the bar 40*b;* with the opposite side of the target support 50 facing the participants and the upper and lower ends of the target support 50 in opposite positions.

It is noted that the above described target system 10 can be rotated, for example, 90 degrees such that the frame members 34 are positioned horizontally one above the other and the target assembly 36 rotates to provide a horizontal movement instead of a vertical movement. It will be understood that other non-horizontal and non-vertical angles of rotation are also contemplated In the above described configurations of the target system of FIG. 8, competition among participants may take various forms. For example, as for the other traveling target systems described, competitors may compete to expose and impact or hide and protect the secondary reactive target(s) 24 employed on the target assembly 36. Alternatively, the target system 10 shown in FIG. 8 may be configured to employ two primary reactive targets 12 on each side of the target support 50, i.e. no secondary reactive target 24 is used. In this configuration, a competition between participants may take the form of a race between the participants to move their respective target assemblies 36 from one end of the frame members 34 to the opposite end. In this form of competition, each participant may be assigned their own target system 10.

With respect to any of the above described traveling target systems intended for use with, for example bullets or other small, fast moving projectiles, the target frame or a portion of the target frame that supports the primary and secondary reactive targets may employ a material that allow for projectiles to pass through the target frame without causing movement of the target frame relative to the participant. Accordingly, sent or fired projectiles intended for impact with a reactive target but that hit the target frame instead will have no significant impact the position of the reactive targets and the competition as whole. Such impacts upon the frame will ideally have the same effect on the competition as a miss of the target and target frame itself.

The combined weight of the reactive targets and the target frame should be light enough such that the force of the impact of the projectile upon the reactive target will rotate or move the target frame or a portion of the target frame to which the reactive targets are attached. The converse of this is true in that the reactive targets and related frame and structure should not be so light such that the rotation of the target frame may be more than what is desired and/or susceptible to unintended manipulation by environmental elements such as wind.

As will be appreciated based upon the above descriptions, traveling target frames according to the present invention may be formed in a variety of shapes and sizes. For example, in addition to triangular and star cross-sectional shapes, target frames according to the present invention may also have rectangular, hexagonal, round or other geometric cross-sectional shapes. It will also be appreciated that embodiments of the above described traveling target frames intended for use with larger, slower moving projectiles, such as arrows and balls, may incorporate or combine the functionality of the primary reactive target with the paddles 28 shown in FIGS. 5A and 5B; the arms 26 shown in FIG. 4; or the sides 14 shown in FIGS. 2 and 3 supporting the primary reactive target 12.

Swing-Arm Target System

In swing-arm type target systems according to the present invention, the frame of the target system remains stationary relative to the participant and only a portion of the target frame that is attached to the primary reactive target moves when the primary reactive target is impacted by a projectile. Movement of the portion of the target frame and the associated primary reactive target is restricted to rotation about a fixed axis defined by the target frame.

Figure 9:
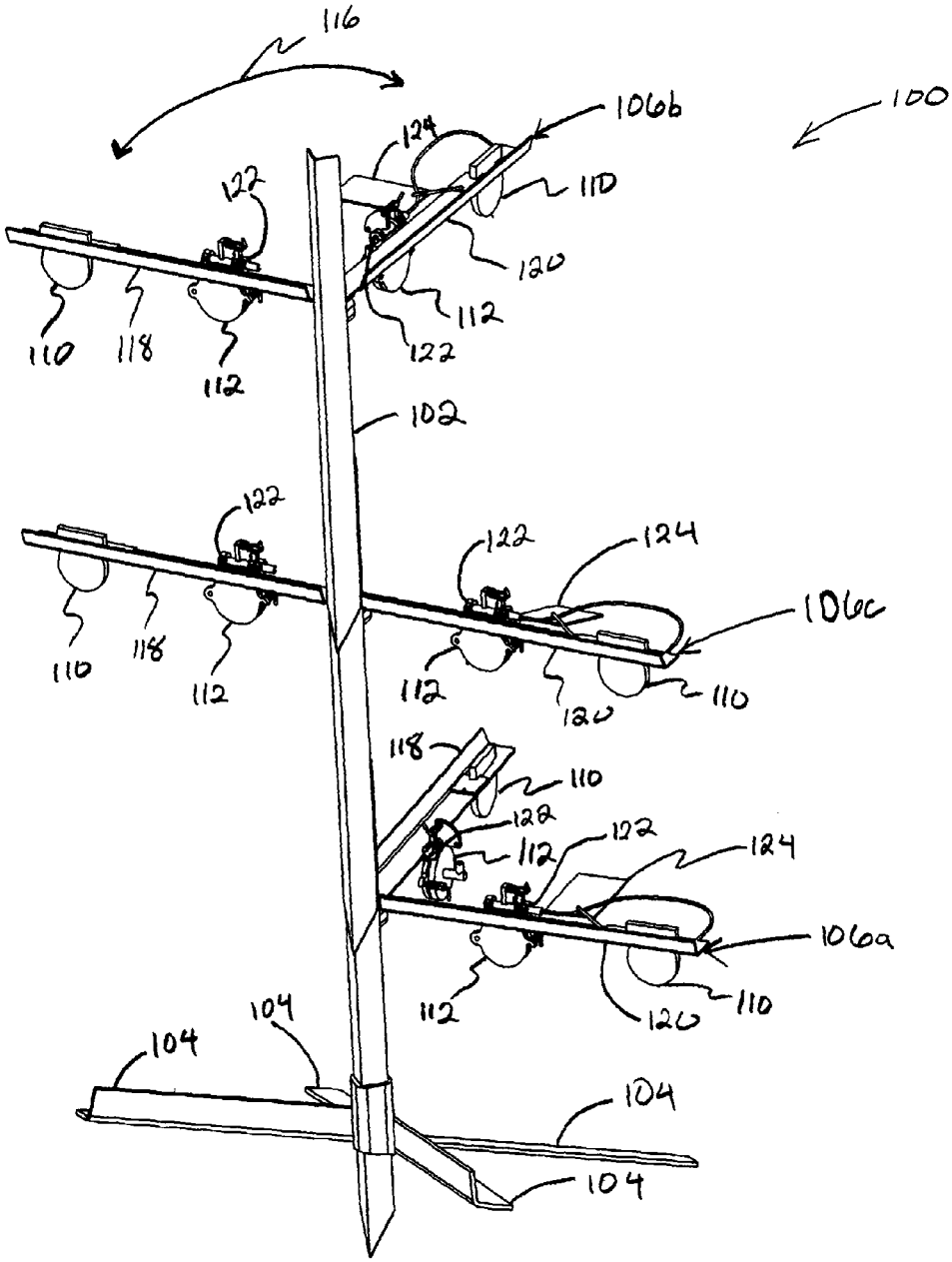
FIG. 9 is a perspective view of a target system according to one embodiment of the present invention.

FIG. 9 shows a swing-arm target system 100 having legs 104 that support and stabilize post 102. Attached to the post 102 are swing arms 106*a*, 106*b*, and 106*c*. Swing arms 106*a*, 106*b*, 106*c* comprise a first member 118 and second member 120. Attached to the first and second members 118, 120 are one or more primary reactive targets 110 and one or more secondary reactive targets 112. The primary reactive targets 110 and the secondary reactive targets 112 may be attached to the first and second members 118, 120 in a variety of manner, including, for example, insertion of individual primary reactive targets 110 and secondary reactive targets 112 through holes or recessed cut into the first and second members 118, 120. This configuration allows the participants to easily alter the positioning of the primary reactive targets 110 and the secondary reactive targets 112 within the target system 100, as well as facilitates replacement of the primary reactive targets 110 and the secondary reactive targets 112.

The first and second members 118 and 120 of swing arms 106*a* and 106*b* are fixed relative to one another such that the first member 118 forms an angle of approximately 90 degrees with the second member 120. The point at which the first and second members 118 and 120 are attached to one another, obscured from view behind post 102, is pivotally attached to post 102 such that the swing arms 106*a* and 106*b* rotate in the directions indicated by line 116. Alternatively stated, swing arms 106*a* and 106*b* are operable to swing from the position of swing arm 106*a* shown in FIG. 9 to the position of swing arm 106*b* shown in FIG. 9.

Primary reactive targets 110 are rigidly attached to the first and second members 118 and 120 of the swing arms

106*a* and 106*b*, such that the force of an impact from a projectile upon the primary reactive targets 110 is transferred to the swing arm 106*a*, 106*b*, 106*c* to which the primary reactive target is attached. The With respect to the swing arm 106*a*, the impact force causes the swing arm 106*a* to rotate such that the second member 120 move substantially behind the post 102 and the first member 11 moves from behind the post 102 into view of the participant(s). The swing arm 106*b* functions analogously to the swing arm 106*a*.

With respect to swing arm 106*c*, the first and second members 118 and 120 of the swing arm 106*c* are not fixed to one another and may be impacted and rotated behind the post 102 individually. The first and second members 118 and 120 may both ultimately be impacted and rotated behind the post 102. Alternatively, the first and second members 118 and 120 of the swing arm 106*c* may initially start in a position as shown in FIG. 9 and then be locked into a configuration or angular relationship as described above for swing arms 106*a* and 106*b* after impact of either first and second members 118 and 120.

As will be noted from FIG. 9, the post 102 is positioned at an angle other than 90 degrees relative to the legs 104 and the surface or ground upon which the target frame 100 rests. Preferably, an upper most end of the post 102 is angled towards the participant. In this configuration, the primary and secondary reactive targets 110 112 are angled such that a projectile that impacts them is safely deflected to the ground.

The secondary reactive targets employed in the target system 100 may be any one of the secondary reactive targets described above. As shown, the secondary reactive targets 112 employed in the target system 100 are of the type shown in FIGS. 1A and 1B. In order for the force of a projectile impact upon the secondary reactive target 112 to not be significantly transferred to the associated swing arms 106*a*, 106*b*, 106*c*, the secondary reactive target 112 is attached to the first or second members 118 and 120 by a hinge 122. Accordingly, the force of the projectile impact upon the secondary reactive target 112 causes a signal to the participant, through activation of an audible signal or a flag 124, and then deflects in the direction of the travel of the projectile. Alternatively, the force of the projectile impact upon the secondary target 112 disables or releases a primary reactive target 110 from the first or second members 118 and 120.

It will be appreciated that the above described target system 100 may be alternatively configured to employ any number of the swing arms 106*a*, 106*b*, and 106*c*. Furthermore, the orientation and combination of the swing arms 106*a*, 106*b*, and 106*c* employed may be altered according to the rules and objectives of the games and competitions for which the target system is used, as well as the type of projectile used.

Figure 10:
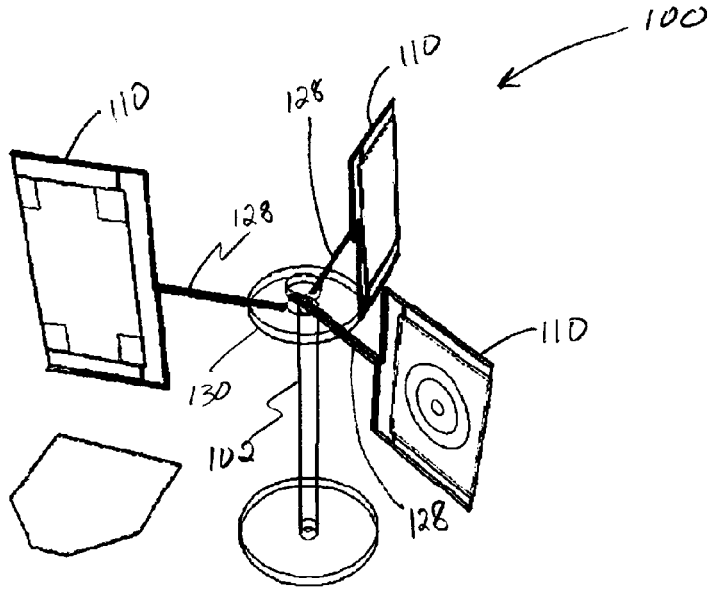
FIG. 10 is a perspective view of a target system according to one embodiment of the present invention.

FIG. 10 shows another configuration of a swing-arm target system according to the present invention. The target system 100 of FIG. 10 is intended for use with baseballs or other similar projectiles. As shown, the primary reactive targets 110 are attached to the ends of supports 128 which are, in turn, pivotally attached to the post 102 by hub 130. The supports 128 may be rigid or flexible depending on the desired rotation and the type of projectile used with the target system 100. When the primary reactive target 110 is impacted by a projectile, the hub 130 is biased by, for example magnetism or friction, to stop rotation of the supports 128 and primary reactive targets 110 at a specific orientation relative to the participant. These biasing techniques may also be employed such that they require a participant to impel a projectile with a minimum amount of force in order to cause rotation, e.g. impact the target by throwing a baseball at or over a specific speed. Within certain of the primary reactive targets, on the support 128 or associated with the hub 130, one of more secondary reactive targets, not shown, may be employed to notify the participants of impact by a projectile.

It will be appreciated that the target system 100 of FIG. 10 may employ any number, including one, of primary reactive targets 110 associated with supports 128. A plurality of hubs 130 associating supports 128 to the post 102 may also be attached to the post 102.

Furthermore, it will be appreciated that the target system 100 of FIG. 10 may be turned or rotated, for example, 90 degrees such that the post 102 is positioned horizontally over the ground. In horizontal configurations, differential weights between the primary reactive targets 110 and/or the supports 128 may be employed such that, after rotation, the hub returns to a desired position relative to the participant. In this configuration, a first primary reactive target 110 may be impacted such that it rotates from an upward position to a downward position. A second primary reactive target 110 that is coupled to the first primary reactive target may then be impacted to rotate the first primary target back to the initial, up-right position. For example, primary reactive targets 110 may be formed of foam or a similar material and used with different types of arrow, blunt tip arrows in a first round of the competition and then broad head arrows could be used in a second round, causing a polarity of targets and rotation and reducing the chance of arrow "stacking".

Figure 11:
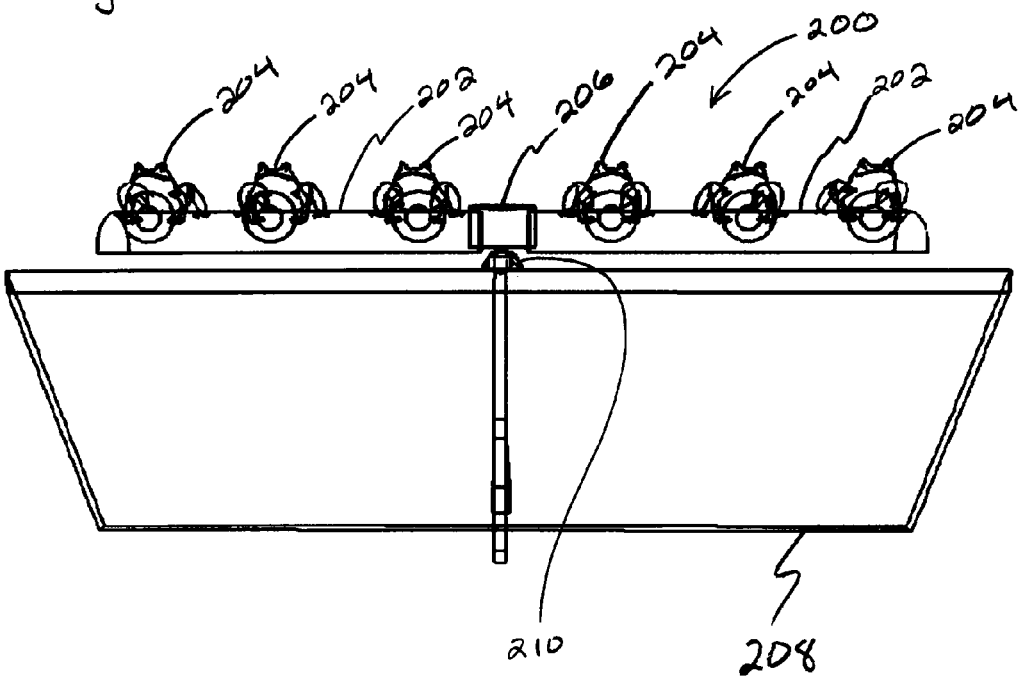
FIG. 11 is a front elevation view of a target system according to one embodiment of the present invention.

FIG. 11 shows yet another embodiment of the present invention. The target system 200 comprises targets 204 mounted on arms 202 which are attached to hub 206. While shown as separate elements arms 202 may comprise a single bar or element spanning across the entire width of the target system 200. Through the hub 206 the arms or arm 204 is balanced, similar to a see-saw or teeter-totter, upon the post 210. The target system 200 further comprises wall 208 which serves to safely deflect projectiles towards the ground.

In use, when a projectile impacts the target 204, the target 204 is knocked off of the arm 202. Removal of one target 204 changes the balance of the arm 202 and the side of the arm 202 from which the target was removed raises above the opposite side of the arm 202. Participants may compete to remove all the targets from one side of the arm 202 before the arm 202 falls behind the wall 208. Accordingly, each successive impact upon a target makes the competition more difficult for at least one of the participants.

The target system 200 may further comprise secondary reactive targets, not shown, that move laterally along the arm 202 as a result of impacted from a projectile. In this manner a participant may defensively block the participants own primary reactive targets from the other competitor. Alternatively, the secondary reactive targets are constructed to have a different weight than the primary reactive targets. The secondary reactive targets are distributed on the arm 202 such that a participant may work offensively or defensively raise or lower the different sides of the arm 202.

It will be appreciated that for any of the above described target systems, electronic scoring or automated resetting systems known in the art may be incorporated into the targeting system. Furthermore, the above described methods for competition and training may be implemented in video and online gaming environments.

Various forms of competition are contemplated for use with the target systems described above. Through employing both primary reactive and secondary reactive targets, each form of competition may but need not necessarily include both offensive and defensive challenges for the participants. Impact of one type of target may be the primary objective of the competition, while impact of the other type of target may be used to block or otherwise hinder this objective. With the target systems that move away from the participants with each impact of a primary reactive target, the difficulty encountered to impact a target increases, i.e. the difficulty of the competition increases as the competition proceeds.

One form of competition may challenge the participants to impact as many secondary targets as possible in a fixed period of time. Alternatively, the participants may compete to impact as many secondary targets as possible with a fixed number of projectiles. In each competition, the participant impacting the greatest number of targets would win the competition. Competitions may also challenge the participants to be the first participant to impact all of the secondary reactive targets of the opponent. Finally, competitions may challenge the participants to cause the target(s) of their target system to travel the greatest distance during a fixed time or number of projectiles.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A projectile target system comprising:

a frame having a paddle wheel form comprising:

a hub;

a first primary target attached to the hub;

a second primary target attached to the hub;

a third primary target attached to the hub; and a secondary target attached to the hub, the secondary target having a planar surface;

wherein each of the first, second and third primary targets extends radially outward from the hub;

wherein the secondary target extends in an axial direction from the hub;

wherein, when any one of the first, second, and third primary targets is alternatively exposed to a stationary participant, the projectile target system is supported on a surface only by two of the first, second, and third primary targets alternatively not exposed to the stationary participant;

wherein said frame is configured such that upon impact of the secondary target each of said first, second, and third primary targets are removed from a line of sight of a stationary user of the target system.

2. The projectile target system of claim 1 wherein the first primary target comprises a paddle.

3. The projectile target system of claim 1 wherein the frame comprises statically associated elements.

4. The projectile target system of claim 1 wherein the frame is rotatable around an axis.

* * * * *